US005109641A

United States Patent [19]

Halan

[11] Patent Number: 5,109,641

[45] Date of Patent: May 5, 1992

[54] ROOF TRANSITION FLASHING

[76] Inventor: Peter Halan, 49669 Shelby Rd., Utica, Mich. 48087

[21] Appl. No.: 657,082

[22] Filed: Feb. 19, 1991

[51] Int. Cl.[5] ..... E04D 1/36; E04D 3/38; E04D 13/14

[52] U.S. Cl. ..... 52/62; 52/58; 52/97; 52/276; 52/288

[58] Field of Search ..... 52/58, 59, 60, 61, 62, 52/96, 97, 219, 273, 276, 281, 288, 94

[56] References Cited

U.S. PATENT DOCUMENTS

| | | | |
|---|---|---|---|
| 1,927,881 | 9/1933 | Wetmore . | |
| 2,620,519 | 12/1952 | Engelbach | 52/276 |
| 3,527,012 | 9/1970 | Hemminger | 52/97 |
| 3,698,142 | 10/1972 | Thenault | 52/58 |
| 3,838,544 | 10/1974 | Hindall . | |
| 4,391,068 | 7/1983 | Kosar | 52/97 |
| 4,583,333 | 4/1986 | Minter . | |
| 4,594,819 | 6/1986 | Kneisel | 52/60 |
| 4,603,517 | 8/1986 | Lyons, Jr. . | |
| 4,700,512 | 10/1987 | Laska . | |
| 4,781,008 | 11/1988 | Lyons, Jr. . | |

FOREIGN PATENT DOCUMENTS

| | | | |
|---|---|---|---|
| 1542630 | 3/1979 | United Kingdom | 52/58 |

*Primary Examiner*—David A. Scherbel

*Assistant Examiner*—Robert Canfield

*Attorney, Agent, or Firm*—Brooks & Kushman

[57] ABSTRACT

A roof transition flshing (10) for installation to a building at a juncture between a vertical wall (40) and an edge (46) of a sloped roof (44), to prevent water flowing along the flashing (10) from seeping behind siding (42) located on the vertical wall (40) and shingles (48) located on the sloped roof (44). The roof transition flashing (10) comprises an L-shaped member having a vertical planar section (16) and a transverse planar section (18). The transverse planar section (18) extends generally laterally from the vertical planar section (16) and is joined thereto by a first imperforate seam (20). The vertical planar section (16) is positioned under the siding (42) and flush with the vertical wall (40) and the transverse planar section (18) is positioned under the shingles (48) and flush with the sloped roof (44). The L-shaped member has an upper end (14) and a relatively lower end (12). A deflector means (22) sealingly cooperates with the lower end (12) of the L-shaped member so that when the roof transition flashing (10) is positioned with the lower end (12) adjacent the edge (46) of the sloped roof (44), the water flowing along the roof flashing (10) toward the edge (46) of the sloped roof (44) will be deflected away from the vertical planar section (16) and away from the siding (42), to prevent the water from seeping behind the siding (42).

18 Claims, 1 Drawing Sheet

ROOF TRANSITION FLASHING

TECHNICAL FIELD

The present invention is related to a one-piece roof transition flashing for use in the construction of buildings. More specifically, the present invention relates to a one-piece roof transition flashing for use at a juncture between a vertical wall and an edge of a sloped roof, to prevent water from seeping behind siding.

BACKGROUND ART

A common problem in the construction business is that of weatherproofing structural junctures, such as that between a vertical wall and a sloped roof. Weatherproofing serves the goal of protecting the underlying structure from the damage associated with water seepage, e.g. rotting of wood, loss of insulation effectiveness and cracking of masonry, and the like. The standard practice is to cover the seams associated with such junctures with flashing.

Typically, such flashing is made of a metal material and is comprised of two planar sections. The planar sections are disposed at some angle relative to each other, resulting in an L-shaped flashing. One section is positioned under the siding and affixed to the vertical wall, and the other section is positioned under the shingles and affixed to the sloped roof. This type of flashing is normally placed along the entire seam created by the juncture.

At the point where the vertical wall and the edge of the sloped roof coincide, however, the flashing is disposed abutting the siding on the vertical wall. Additional sealing is required at this point to prevent water from running off of the flashing, seeping behind the siding and causing damage to the underlying structure. This sealing is usually roof cement or caulking and is applied to the flashing and the siding. The problem with such a method is that due to shrinkage of the caulk over time, thermal expansion and contraction of the dissimilar materials, and weathering, the seal fails and water seeps behind the siding.

DISCLOSURE OF THE INVENTION

The invention is a one-piece roof transition flashing for use at a juncture between a vertical wall and an edge of a sloped roof that provides a means for preventing water from seeping behind siding and causing the damage associated therewith. The flashing has a vertical planar section and a transverse planar section and is generally L-shaped. Additionally, a generally L-shaped step, or deflector, is formed on the lower end of the flashing.

At the juncture between the vertical wall and the edge of the sloped roof, the vertical planar section is positioned under siding material and flush with the vertical wall, and the transverse planar section is positioned under roofing material and flush with the sloped roof. The deflector wraps around the siding, which abuts to the flashing. The flashing of the present invention thus cooperates with the siding material, and diverts water flowing down the juncture away from the siding.

The flashing of the present invention may also utilize a drip flange. The drip flange is formed on the lower end of the transverse planar section of the flashing, and extends generally downward from the transverse planar section. The drip flange thus cooperates with the transverse planar section to fit over the edge of the sloped roof, thereby serving to prevent water from seeping under the shingles.

Accordingly, it is a primary object of the present invention to provide a roof transition flashing for use at a juncture between a vertical wall and an edge of a sloped roof, having a deflector which prevents water from seeping behind siding materials.

It is a further object of the invention to provide a one-piece flashing made of a plastic material.

It is another object of the present invention to provide a one-piece flashing having a drip flange which prevents water from seeping behind the shingles.

The above objects and other objects and features of the invention will be readily appreciated by one of ordinary skill in the art from the following detailed description of the best modes for carrying out the invention, when taken in connection with the accompanying drawings.

BEST MODES FOR CARRYING OUT THE INVENTION

Figure 2:
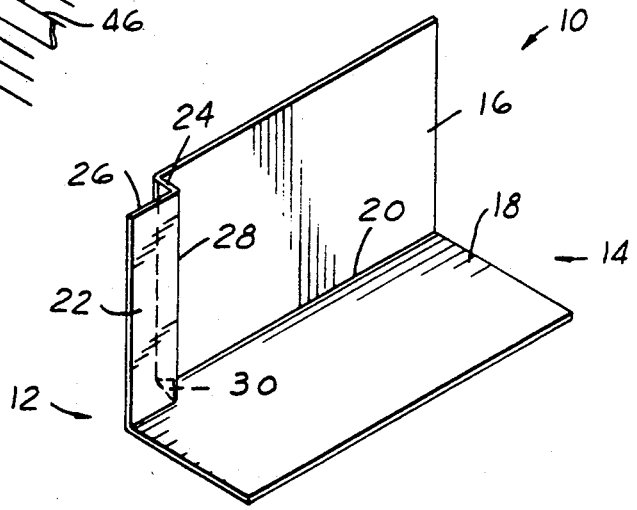
FIG. 2 is a perspective view of the first embodiment of the roof transition flashing of the present invention.
Figure 3:
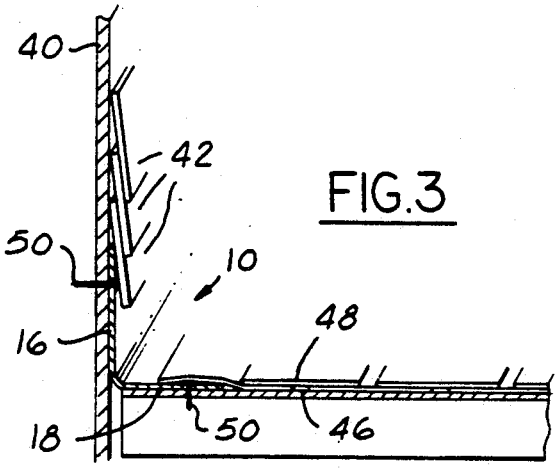
FIG. 3 is a cross-sectional view of the roof transition flashing of FIG. 1, taken along line 3—3.

Referring now to FIG. 2 and FIG. 3, a first embodiment of the present invention is shown generally by reference numeral 10. Roof transition flashing 10 has a lower end 12 and an upper end 14 and is comprised of a vertical planar section 16, a transverse planar section 18 and a deflector 22.

Vertical planar section 16 and transverse planar section 18 are joined by a first imperforate seam 20. Transverse planar section 18 extends generally laterally from vertical planar section 16, thereby resulting in a generally L-shaped roof transition flashing 10.

Deflector 22 is sealingly formed on roof transition flashing 10 at lower end 12 and is comprised of a first leg 24 and a second leg 26. First leg 24 is formed on vertical planar section 16 generally orthogonally thereto and second leg 26 is formed on transverse planar section 18 generally parallel to vertical planar section 16.

Second leg 26 extends generally laterally from first leg 24, thereby resulting in a generally L-shaped deflector 22, or step. First leg 24 and second leg 26 are joined by a second imperforate seam 28.

At the corner created by the meeting of vertical planar section 16, transverse planar section 18 and deflector 22, transverse planar section 18 is built up, so as to create an inclined portion 30. This construction helps to prevent the accumulation of debris and foreign objects in the corner.

In the preferred embodiment, roof flashing 10 is a one-piece flashing made of a plastic material. Since the plastic material can be transparent or translucent, the roof transition flashing easily blends in with the siding, resulting in an aesthetic quality difficult to achieve utilizing the metal roof flashings of the prior art. Additionally, the flashing of the present invention can be made from an injection molding process, resulting in an inexpensive and corrosion-free roof transition flashing.

Figure 1:
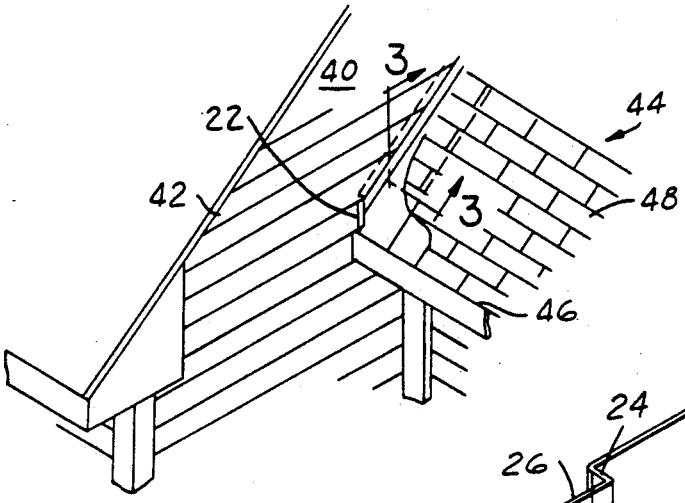
FIG. 1 is a perspective view of a typical application of the roof transition flashing of the present invention.

As illustrated in FIG. 1 and FIG. 3, roof transition flashing 10 is designed for installation to a building at a juncture between a vertical wall 40 and an edge 46 of sloped roof 44. FIG. 3 is a cross-sectional view of the roof flashing 10 as shown in FIG. 1, taken along line 3—3. It should be noted that FIG. 3, when viewed alone, is representative of the flashings of the prior art.

For this application, the exterior of the walls of the building will have siding, and the roof will have shingles. It should be appreciated that the term "siding" encompasses the various types of known exterior wall coverings, e.g. horizontal plank, vertical or sheet aluminum, vinyl, cedar, or the like. It should also be appreciated that the term "shingles" is intended to encompass the various types of known roofing materials, e.g. asphalt, tar paper, shingles, metal, slate or the like.

Roof transition flashing 10 is positioned at the juncture so that the lower end 12 is located proximate to the edge 46 of sloped roof 44. Vertical planar section 16 is positioned flush with the vertical wall 40, and transverse planar section 18 is positioned flush with the sloped roof 44. Vertical planar section 16 and transverse planar section 18 can then be affixed to the vertical wall 40 and the sloped roof 44, respectively, utilizing nails 50, staples or any of the other fastening techniques known to one of ordinary skill in this art, such as adhesives.

The shingles 48 are installed on the sloped roof 44. Referring again to FIG. 3, it can be seen the shingles 48 are applied in the usual manner and generally extend over the transverse planar section 18.

The siding 42 is installed in the usual manner on the vertical wall 40. As shown in FIG. 3, the siding 42, when installed, generally extends partially over the vertical planar section 16. At the edge 46 of the sloped roof 44, however, the deflector 22 wraps around the siding 42, which terminates behind the deflector 22, in close proximity to the first leg 24.

Water flowing down the sloped roof 44 along the roof flashing 10 toward the edge 46 is deflected away from the vertical planar section 16 and away from the siding 42. Thus, the water is prevented from seeping behind the siding 42 and causing damage to the underlying structure.

Although the embodiment shown represents deflector 22 as being generally perpendicular to transverse planar section 18, it should be appreciated that deflector 22 could be formed on roof flashing 10 at some angle relative to transverse planar section 18. Such a construction would facilitate the use of siding materials having an end cut at some angle, instead of a squared-off end. Thus, the deflector 22 wraps around and accommodates the angled end, as in the embodiment shown.

Figure 4:
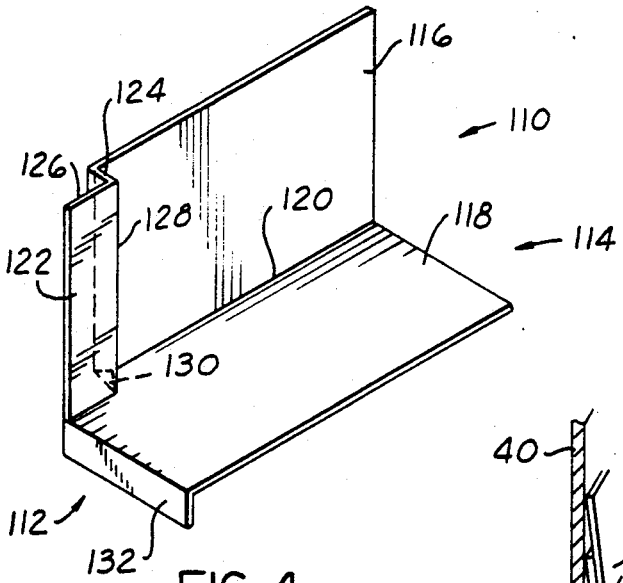
FIG. 4 is a perspective view of a second embodiment of the roof transition flashing of the present invention.

A second embodiment of the present invention is illustrated in FIG. 4, wherein like-numbered items appear in FIG. 2, less 100.

As in the first embodiment, roof transition flashing 110 is a one-piece flashing made of a plastic material. The flashing 110 is designed for installation to a building at a juncture between a vertical wall and an edge of a sloped roof, not specifically illustrated. Vertical planar section 116 is positioned flush with the vertical wall and affixed thereto, and transverse planar section 118 is positioned flush with the sloped roof and affixed thereto.

Roof transition flashing 110 has a lower end 112 and an upper end 114 and is comprised of a vertical planar section 116, a transverse planar section 118 joined thereto by a first imperforate seam 120, a deflector 122 and a drip flange 132. Inclined portion 130 helps to prevent the accumulation of debris and foreign objects in the corner created by vertical planar section 116, transverse planar section 188 and deflector 122.

Deflector 122 is formed on roof transition flashing 110 at the lower end 112. It should be appreciated that deflector 122 could be formed on roof transition flashing 110 at some angle relative to transverse planar section 118.

Drip flange 132 is formed on the lower end 112 of roof transition flashing 110 and extends in a generally downward direction from transverse planar section 118. The drip flange 132 thus cooperates with the transverse planar section 118 to fit over an edge of a sloped roof, thereby serving to prevent water flowing off of roof flashing 110 from seeping under the shingles.

It is understood, of course, that while the forms of the invention herein shown and described constitute preferred embodiments of the invention, they are not intended to illustrate all possible forms thereof. It should also be understood that the words used are words of description rather than limitation, and that various changes may be made without departing from the spirit and scope of the invention disclosed.

What is claimed is:

1. A roof transition flashing for installation to a building at a juncture between a vertical wall and an edge of a sloped roof, to prevent water flowing along the flashing from seeping behind siding located on the vertical wall and shingles located on the sloped roof, the roof transition flashing comprising:

an L-shaped member having a vertical planar section and a transverse planar section joined thereto by a first imperforate seam, said vertical planar section being positioned under the siding and flush with the vertical wall, said transverse planar section extending generally laterally from said vertical planar section and being positioned under the shingles and flush with the sloped roof, said L-shaped member having an upper end and a relatively lower end for installation adjacent the edge of the sloped roof; and deflector means sealingly cooperating with the lower end of the L-shaped member for diverting the water away from said vertical planar section and away from the siding, so that when the roof transition flashing is positioned with said lower end adjacent the edge of the sloped roof, the water flowing along the roof flashing toward the edge of the sloped roof will be deflected away from said vertical planar section and away from the siding, to prevent the water from seeping behind the siding.

2. The roof transition flashing of claim 1 wherein said deflector means further comprises a generally L-shaped deflector having a first planar leg and a second planar leg joined thereto by a second imperforate seam.

3. The roof transition flashing of claim 2 wherein said second imperforate seam is generally perpendicular to said transverse planar section.

4. The roof transition flashing of claim 1 wherein the flashing is formed of a plastic material.

5. The roof transition flashing of claim 4 wherein said plastic material is transparent.

6. The roof transition flashing of claim 4 wherein said plastic material is translucent.

7. The roof transition flashing of claim 1 further comprising a drip flange, said drip flange extending in a generally downward direction from said transverse planar section along a third imperforate seam, said drip flange cooperating with said transverse planar section to fit over an edge of the sloped roof, thereby preventing the water from seeping under the shingles.

8. The roof transition flashing of claim 7 wherein the flashing is formed of a plastic material.

9. The roof transition flashing of claim 8 wherein said plastic material is transparent.

10. The roof transition flashing of claim 8 wherein said plastic material is translucent.

11. A roof transition flashing for installation to a building at a juncture between a vertical wall and an edge of a sloped roof, to prevent water flowing along the flashing from seeping behind siding located on the vertical wall and shingles located on the sloped roof, the roof transition flashing comprising:

an L-shaped member having a vertical planar section and a transverse planar section joined thereto by a first imperforate seam, said vertical planar section being positioned under the siding and flush with the vertical wall, said transverse planar section extending generally laterally from said vertical planar section and being positioned under the shingles and flush with the sloped roof, said L-shaped member having an upper end and a relatively lower end for installation adjacent the edge of the sloped roof; and a generally L-shaped deflector having a first planar leg generally perpendicular to said vertical planar section and a second planar leg generally perpendicular to said first planar leg and joined thereto by a second imperfect seam, said deflector sealingly cooperating with the lower end of the L-shaped member for diverting the water away from said vertical planar section and away from the siding, so that when the roof transition flashing is positioned with said lower end adjacent the edge of the sloped roof, the water flowing along the roof flashing toward the edge of the sloped roof will be deflected away from said vertical planar section and away from the siding, to prevent the water from seeping behind the siding.

12. The roof transition flashing of claim 11 wherein said second imperforate seam is generally perpendicular to said transverse planar section.

13. The roof transition flashing of claim 11 wherein the flashing is formed of a plastic material.

14. The roof transition flashing of claim 11 further comprising a drip flange, said drip flange extending in a generally downward direction from said transverse planar section along a third imperforate seam, said drip flange cooperating with said transverse planar section to fit over an edge of the sloped roof, thereby preventing the water from seeping under the shingles.

15. The roof transition flashing of claim 14 wherein said flashing is formed of a plastic material.

16. A roof transition flashing for installation to a building at a juncture between a vertical wall and an edge of a sloped roof, to prevent water flowing along the flashing from seeping behind siding located on the vertical wall and shingles located on the sloped roof, the roof transition flashing comprising:

an L-shaped member having a vertical planar section and a transverse planar section joined thereto by a first imperforate seam, said vertical planar section being positioned under the sidign and flush with the vertical wall, said transverse planar section extending generally laterally from said vertical planar section and being positioned under the shingles and flush with the sloped roof, said L-shaped member having an upper end and a relatively lower end for installation adjacent the edge of the sloped roof;

a generally L-shaped deflector having a first planar leg generally perpendicular to said vertical planar section and a second planar leg generally perpendicular to said first planar leg and joined thereto by a second imperforate seam, said deflector sealingly cooperating with the lower end of the L-shaped member for diverting the water away from said vertical planar section and away from the siding; and a drip flange extending in a generally downward direction from said transverse planar section along a third imperforate seam, said drip flange cooperating with said transverse planar section to fit over an edge of the sloped roof, thereby preventing the water from seeping under the shingles, so that when the roof transition flashing is positioned with said lower end adjacent the edge of the sloped roof, the water flowing along the roof flashing toward the edge of the sloped roof will be deflected away from said vertical planar section and away from the sliding, to prevent the water from seeping behind the siding.

17. The roof transition flashing of claim 16 wherein said second imperforate seam is generally perpendicular to said transverse planar section.

18. The roof transition flashing of claim 16 wherein said flashing is formed of a plastic material.

* * * * *